US008007071B2

(12) United States Patent
Hayakawa

(10) Patent No.: US 8,007,071 B2
(45) Date of Patent: Aug. 30, 2011

(54) IMAGE FORMING APPARATUS AND INFORMATION RECORDING MEDIUM

(75) Inventor: Kiyoharu Hayakawa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 482 days.

(21) Appl. No.: 12/284,990

(22) Filed: Sep. 26, 2008

(65) Prior Publication Data

US 2009/0085940 A1 Apr. 2, 2009

(30) Foreign Application Priority Data

Oct. 2, 2007 (JP) ..... 2007-258452

(51) Int. Cl.
*B41J 2/165* (2006.01)
*B41J 29/393* (2006.01)
*B41J 29/38* (2006.01)

(52) U.S. Cl. ..... 347/23; 347/5; 347/19; 347/20; 347/22; 347/25; 347/29; 347/30

(58) Field of Classification Search ..... 347/5, 19, 347/23, 30

See application file for complete search history.

(56) References Cited

U.S. PATENT DOCUMENTS

| | | | | |
|---|---|---|---|---|
| 7,410,248 | B2 * | 8/2008 | Umeda et al. | 347/85 |
| 7,661,805 | B2 * | 2/2010 | Usui | 347/92 |
| 2002/0196316 | A1 * | 12/2002 | Nakamura | 347/84 |
| 2004/0056918 | A1 * | 3/2004 | Wang et al. | 347/21 |
| 2006/0001715 | A1 | 1/2006 | Umeda et al. | |

FOREIGN PATENT DOCUMENTS

| | | |
|---|---|---|
| JP | 6008458 | 1/1994 |
| JP | 3098620 | 8/2000 |
| JP | 2004-255861 | 9/2004 |

* cited by examiner

*Primary Examiner* — Ryan Lepisto
(74) *Attorney, Agent, or Firm* — Frommer Lawrence & Haug LLP

(57) ABSTRACT

An image forming apparatus includes: a liquid tank which retains a liquid; a liquid jetting head connected to the liquid tank and having a nozzle for jetting the liquid; a carriage on which the liquid tank and the liquid jetting head are provided; a recovery mechanism which recovers the liquid jetting head; a memory which retains predetermined history information; and a controller which controls the recovery mechanism based on the history information. The recovery mechanism selectively executes a first recovery operation for discharging air from the liquid tank and a second recovery operation for discharging air from the liquid tank and for discharging the liquid from the nozzle, and the controller controls the recovery mechanism to perform the first recovery operation if the history information in the memory includes an abnormality when a power of the image forming apparatus is switched ON.

12 Claims, 6 Drawing Sheets

IMAGE FORMING APPARATUS AND INFORMATION RECORDING MEDIUM

CROSS REFERENCE TO RELATED APPLICATION

The present application claims priority from Japanese Patent Application No. 2007-258452, filed on Oct. 2, 2007, the disclosure of which is incorporated herein by reference in its entirety.

BACKGROUND OF THE INVENTION

1. Field of the Invention

The present invention relates to an image forming apparatus which forms an image on an image-formation medium by jetting a liquid from a nozzle, and an information recording medium in which a program for controlling the image forming apparatus is recorded.

2. Description of Related Art

Generally, an image forming apparatus, for example, an ink jet printer is provided with an ink-jet head which jets ink from a nozzle onto a recording medium and an ink tank which supplies the ink to the ink-jet head, on a carriage which is supported movably relative to the recording medium. To the ink tank, ink is supplied, via a tube, from an ink cartridge disposed out of the carriage. In this ink jet printer, ink supplied from the ink cartridge via the tube is stored in the ink tank, and after air contained in the ink is separated, the ink stored in the ink tank is supplied to the ink-jet head.

For example, the ink jet printer described in US Patent Application Laid-open No. US2006/0001715 (Japanese Patent Application Laid-open No. 2004-255861) includes a suction cap which is brought into close contact with the nozzles of the ink-jet head and an air-discharge cap provided beside the suction cap, ink increased in viscosity is sucked by the suction cap from the nozzles, and air accumulated in the ink tanks is discharged by the air-discharge cap from air-discharge channels communicating with upper portions of the ink tanks.

Such an ink jet printer generally has a timer function, and performs above described ink suction and air discharge in predetermined periods. However, for example, if the power of an internal battery runs out in a state that the power supply is switched OFF or if the power supply is switched OFF in a state that the ink jet printer is provided with no internal battery, the ink jet printer becomes unable to measure the time. Therefore, thereafter, on the assumption that the ink jet printer was in an unusable state for a long period, that is, on the assumption that the ink in the nozzle is dried and a large amount of air in the ink grows as bubbles in the ink tank, a purge operation is performed for suctioning and discharging large amounts of ink and air.

However, in the ink jet printer described in US Patent Application Laid-open No. 2006/0001715, when the power source is switched ON after the ink jet printer becomes unable to measure the time, in addition to discharge of a large amount of inks from the nozzles as described above, along with air discharge from the upper portions of the ink tanks, inks are further sucked and discharged. If the air is sucked more than an air accumulation amount, the inks are also discharged from the air-discharge channels. Therefore, there has been a problem that the amount of inks to be consumed when the power supply is switched ON increases.

SUMMARY OF THE INVENTION

Therefore, an object of the present invention is to provide an image forming apparatus which prevents consumption of a large amount of liquid when the power supply is switched ON after the image forming apparatus becomes unable to measure the time due to switching OFF of the power supply, and an information recording medium in which a program for controlling the image forming apparatus is recorded.

A first aspect of the present invention provides an image forming apparatus which forms an image on an image forming medium, including: a liquid tank which stores liquid for forming an image; a liquid jetting head which is connected to the liquid tank and has a nozzle for jetting the liquid supplied from the liquid tank onto the image forming medium; a carriage on which the liquid tank and the liquid jetting head are provided; a recovery mechanism which recovers a liquid jetting function, for jetting the liquid, of the liquid jetting head; a memory which retains predetermined history information; and a controller which controls the recovery mechanism based on the history information retained by the memory, and the recovery mechanism selectively executes two recovery operations of a first recovery operation for discharging air from the liquid tank and a second recovery operation for discharging air from the liquid tank and for discharging the liquid from the nozzle, as an operation for recovering the liquid jetting function of the liquid jetting head, and the controller controls the recovery mechanism to perform the first recovery operation in a case that the history information retained in the memory includes an abnormality when a power supply of the image forming apparatus is switched ON.

In the image forming apparatus of the present invention, the memory may include a timer which measures time, and the abnormality in the history information may be a state that the time measured by the timer is not retained in the memory.

According to the image forming apparatus of the present invention, for example, when the power supply of the image forming apparatus is switched ON in a state that the time measured by a timer is not retained due to being switched OFF of the power supply of the image forming apparatus, etc., the controller controls the recovery mechanism to execute the first recovery operation. When the time measured by the timer is not retained in the memory due to being switched OFF of the power supply, etc., that is, when the timer is unable to measure the time, generally, the liquid jetting head is in a non-jetting state, and the liquid jetting head is covered by a cap. Therefore, the liquid in the liquid jetting head is hardly dried, and even when the liquid is jetted immediately after the power supply is switched ON, this rarely causes a jetting failure, so that the operation for discharging the liquid from the nozzles as the jetting function recovery operation is not performed. On the other hand, air in the liquid inside the liquid tank grows with the elapse of time, so that when jetting the liquid from the nozzles for forming an image, it is expected that the period until air is suctioned into the nozzles and causes a jetting failure becomes shorter. Therefore, as the jetting function recovery operation, only the operation for discharging air from the liquid tank is performed. When performing a recovery operation for discharging the liquid from the nozzles in predetermined periods, etc., if an air amount in the liquid tank is large, the air is suctioned into the nozzles, and when jetting the liquid thereafter, the suctioned air may cause a jetting failure. However, by reducing the air amount in the liquid tank as described above, when performing a recovery operation for discharging an ink from the nozzle next, suctioning of air in the liquid tank into the nozzles can be avoided. Therefore, the amount of the liquid to be consumed by the jetting function recovery operation performed after the power supply of the image forming apparatus is switched ON can be reduced before an image recording operation is started.

In the image forming apparatus of the present invention, the controller may judge whether a predetermined time has elapsed since a latest jetting function recovery operation, based on the time measured by the timer, and when the controller judges that the predetermined time has elapsed, the controller may control the recovery mechanism to execute the second recovery operation. In a state that the timer can measure the time, when the predetermined time has elapsed since the previous recovery operation, the controller controls the recovery mechanism to execute the second recovery operation. Accordingly, the ink jetting function can be reliably recovered.

In the image forming apparatus of the present invention, when the power supply of the image forming apparatus is switched ON after the timer becomes unable to measure the time, the controller may set an air discharge amount, from the liquid tank, in the first recovery operation by the recovery mechanism to be not more than an air discharge amount, from the liquid tank, in the second recovery operation by the recovery mechanism in a state that the timer can measure the time. Even when the timer becomes unable to measure the time due to being switched OFF of the power supply of the image forming apparatus and it is expected that a large amount of air is accumulated in the liquid tank, after the power supply of the image forming apparatus is switched ON, by performing an air-discharge operation by the first recovery operation as described above and to discharge an air not more than the air discharge amount of the second recovery operation, a jetting operation can be started without a problem.

In the image forming apparatus of the present invention, the controller may control the liquid jetting head to execute a flushing operation for jetting the liquid from the nozzle in a region on the outside of a region facing the image forming medium before starting image formation on the image forming medium, and further, in a case that the power supply of the image forming apparatus is switched ON after the timer becomes unable to measure the time, and the controller has controlled the recovery mechanism to execute the first recovery operation, the controller may increase the number of times of jetting in the flushing operation, which is to be executed by the liquid jetting head before starting image formation, to be greater than in other cases. When a flushing operation is thus performed before starting image formation after the power supply of the image forming apparatus is switched ON after the timer becomes unable to measure the time, and the first recovery operation is executed, by increasing the number of times of jetting in the flushing operation to be greater than in the flushing operation in other cases, drying of the ink in the nozzles due to omission of discharging liquid from the nozzles can be dealt with.

In the image forming apparatus of the present invention, the memory may include a counter which retains information about the number of droplets of the liquid jetted from the liquid jetting head, and the abnormality in the history information may be a state that the information about the number of droplets is not retained in the counter. The memory may include a counter which retains information about the number of image forming media on which images were formed by the liquid jetting head, and the abnormality in the history information may be a state that the information about the number of image forming media on which images were formed is not retained in the counter.

A second aspect of the present invention provides an information recording medium which is readable by a computer and which includes a computer program recorded on the information recording medium, the computer program causes the computer to: make a judgment with respect to an image forming apparatus, the image forming apparatus including: a liquid tank which retains an image forming liquid; a liquid jetting head which is connected to the liquid tank and has a nozzle for jetting the liquid supplied from the liquid tank onto an image forming medium; a carriage on which the liquid tank and the liquid jetting head are provided; a recovery mechanism which recovers a liquid jetting function for jetting the liquid of the liquid jetting head; and a memory which retains predetermined history information, the judgment being about whether the history information retained in the memory includes an abnormality when a power supply of the image forming apparatus is switched ON; and control the recovery mechanism to discharge air from the liquid tank when the image forming apparatus judges that the history information includes an abnormality.

In the information recording medium of the present invention, the memory may include a timer which measures time, and the abnormality in the history information may be a state that the time measured by the timer is not retained in the memory.

According to the second aspect of the present invention, when the power supply of the image forming apparatus is switched ON, if a time measured by the timer is not retained due to, for example, being switched OFF of the power supply of the image forming apparatus, etc., a computer controls the recovery mechanism of the image forming apparatus to execute the first recovery operation. When a time measured by the timer is not retained in the memory due to being switched OFF of the power supply, etc., that is, when the timer cannot measure the time, generally, the liquid jetting head is in a non-jetting state, and the liquid jetting head is covered by a cap. Therefore, the liquid in the nozzles is hardly dried, and even when the liquid is jetted immediately after the power supply is switched ON, this rarely causes a jetting failure, so that the operation for discharging the liquid from the nozzles as the jetting function recovery operation is not performed. On the other hand, air in the liquid inside the liquid tank grows with the elapse of time, so that when jetting the liquid from the nozzles for forming an image, it is expected that the period until air is suctioned into the nozzles and causes a jetting failure becomes shorter. Therefore, as the jetting function recovery operation, only the operation for discharging air from the liquid tank is performed. When performing a recovery operation for discharging liquid from the nozzles in predetermined periods, etc., if the air amount in the liquid tank is large, the air is suctioned into the nozzles, and when jetting the liquid thereafter, the suctioned air may cause a jetting failure. However, by reducing the air amount in the liquid tank as described above, when performing a recovery operation for discharging the ink from the nozzles next, suctioning of the air in the liquid tank into the nozzles can be avoided. Therefore, the amount of liquid to be consumed by the jetting function recovery operation performed after the power supply of the image forming apparatus is switched ON can be reduced before the image recording operation is started.

DETAILED DESCRIPTION OF THE PREFERRED EMBODIMENTS

Hereinafter, an embodiment of the image forming apparatus of the present invention applied to an ink jet printer will be described with reference to the drawings.

Figure 1:
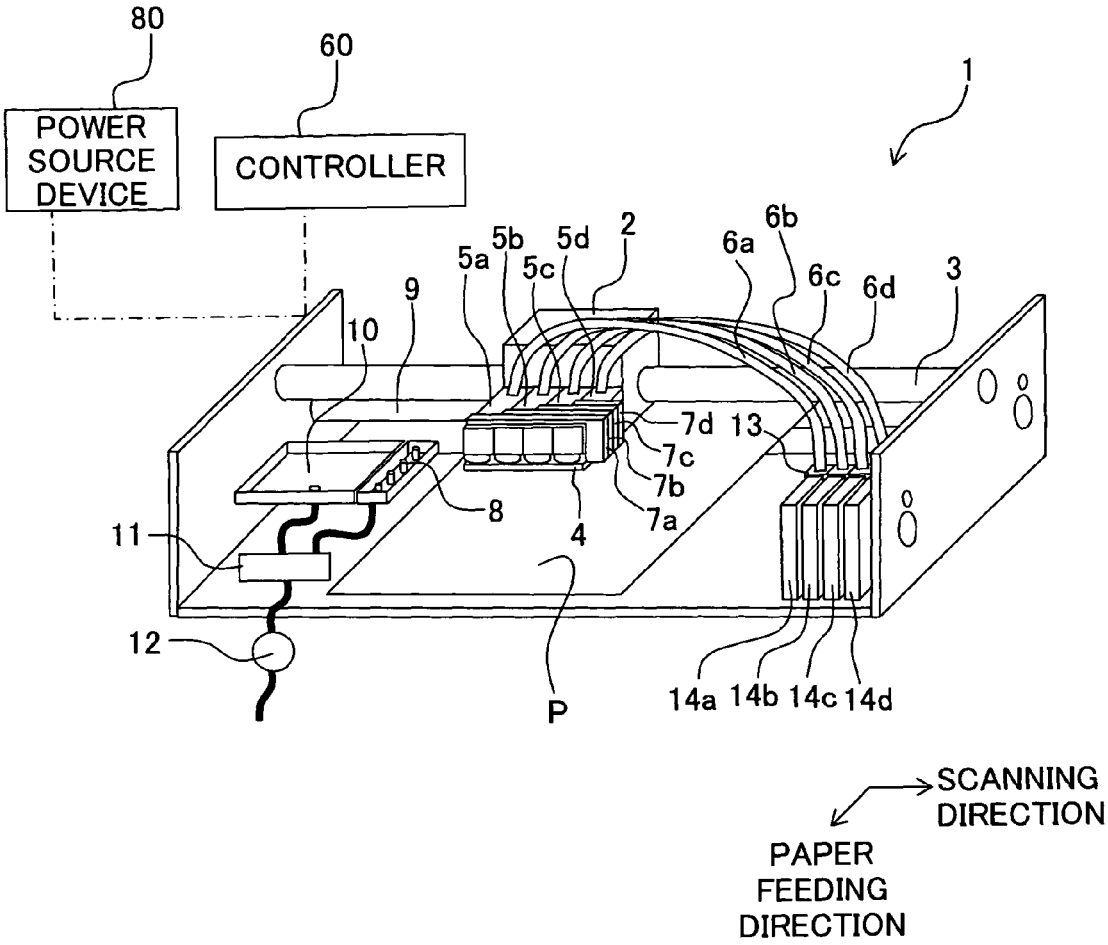
FIG. 1 is a view showing a schematic construction of an ink jet printer according to an embodiment of the present invention.

FIG. 1 is a view showing a schematic structure of an ink jet printer according to an embodiment of the present invention. As shown in FIG. 1, the ink jet printer 1 mainly includes a main scanning device which reciprocates a liquid jetting head, that is, ink-jet head 4 parallel to a paper as an image-formation medium; a transporting device which transports the paper in a direction orthogonal to the reciprocating direction; an ink supply device which supplies an image forming liquid, that is, ink to the ink-jet head 4; and a recovery device (recovery mechanism) which recovers a jetting function of the ink-jet head 4, and further includes a controller 60 which controls operations of these devices; and a power supply device 80 for supplying operation power to the devices.

The main scanning device includes a carriage 2 on which the ink-jet head 4 is provided, and reciprocates the carriage in a scanning direction (left and right direction in FIG. 1) along a guide shaft 3. The ink-jet head 4 has nozzles 25 (see FIG. 2) exposed to the lower surface of the carriage 2, and jets inks toward a paper P from the nozzles 25 while reciprocating in the scanning direction together with the carriage 2.

The ink supply device includes four ink cartridges 14*a* to 14*d* attached to a standstill portion 13 in the ink jet printer 1 out of the carriage 2, four ink tanks 5*a* to 5*d* (liquid tanks) provided on the carriage 2, and four tubes 6*a* to 6*d* connecting the ink cartridges 14*a* to 14*d* and the ink tanks 5*a* to 5*d*, respectively. The ink cartridges 14*a* to 14*d* are filled with inks of black, yellow, cyan, and magenta, respectively. These inks of four colors are supplied into the four ink tanks 5*a* to 5*d* from the ink cartridges 14*a* to 14*d* via the four tubes 6*a* to 6*d*, and further supplied to the ink-jet head 4 from the ink tanks 5*a* to 5*d*.

The transporting device includes a feeding roller 9 for feeding the paper P in a direction (to the front side of the sheet surface in FIG. 1) orthogonal to the scanning direction of the carriage 2 at a position below the nozzles 25 of the ink-jet head 4.

Figure 3A:
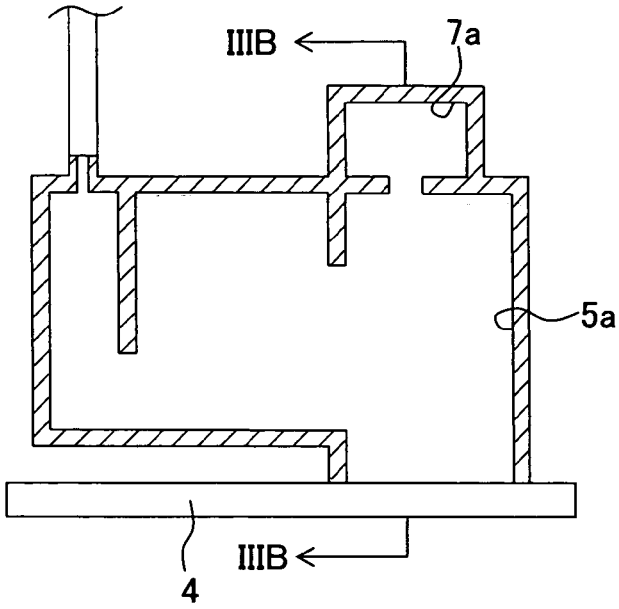
FIG. 3A is a longitudinal sectional view of the ink-jet head and a sub tank portion of FIG. 1.
Figure 3B:
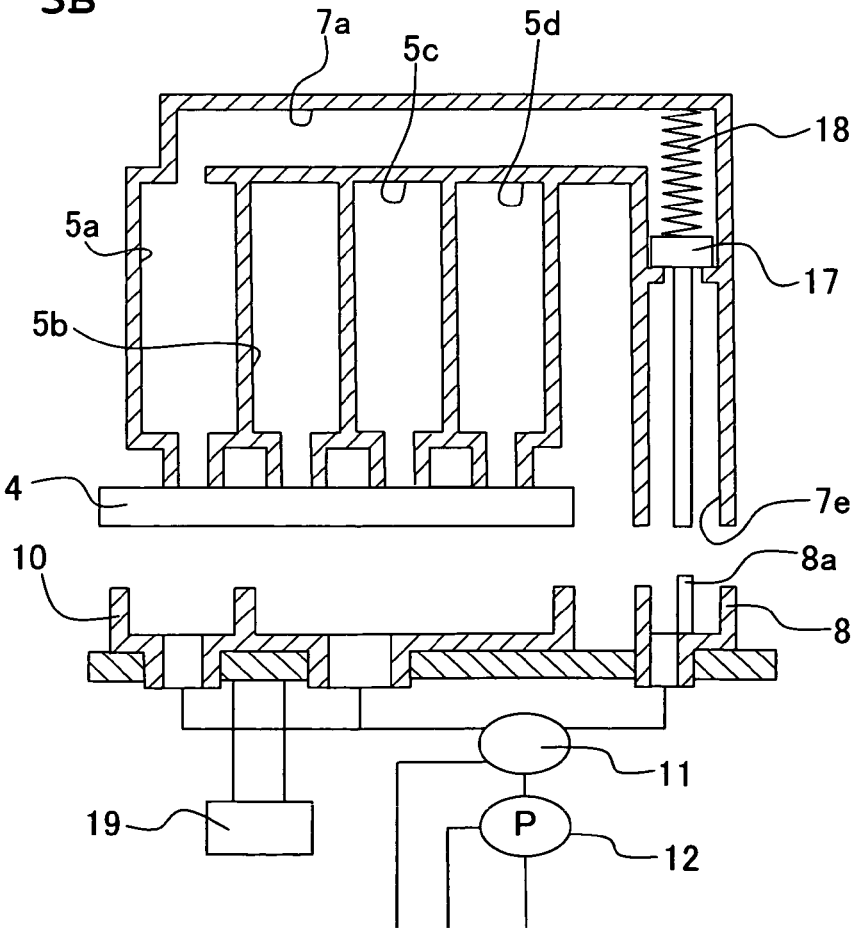
FIG. 3B is a sectional view along IIIB-IIIB of FIG. 3A and a sectional view of a corresponding cap portion.

The recovery device performs a purge operation, an air-discharge operation, and a flushing operation as generally known, and includes an air-discharge cap 8, a purge cap 10, a switching device 11, a suction pump 12, and a lift mechanism 19 described later. For the air-discharge operation, the respective ink tanks 5*a* to 5*d* are provided with air-discharge channels 7*a* to 7*d* which extend rightward from the upper surfaces of the ink tanks and bend at substantially right angles downward at the right end portions as shown in FIG. 3. The four air-discharge channels 7*a* to 7*d* are opened at their lower ends 7*e* to the outside at the side of the ink-jet head 4, and have valves 17 inside, respectively. The valves 17 normally close the air-discharge channels 7*a* to 7*d* with respect to the outside by the action of springs 18.

An air-discharge cap 8 and a purge cap 10 are provided aside of a region of transportation of the paper P in the ink jet printer 1. The air-discharge cap 8 and the purge cap 10 are movable up and down by a lift mechanism 19, and by moving up toward the carriage 2 moved to the outside of the transporting region of the paper P, the air-discharge cap 8 comes into close contact with the lower end openings 7*e* of the air-discharge channels 7*a* to 7*d*, and the purge cap 10 comes into close contact with the lower surface of the ink-jet head 4. The air-discharge cap 8 has push-up projections 8*a* inside, and when the air-discharge cap 8 is connected to the lower end openings 7*e* of the air-discharge channels 7*a* to 7*d*, the projections 8*a* push-up and open the valves 17, and connect the upper spaces inside sub tanks 5 and the inside of the air-discharge cap 8.

It is also allowable that the purge cap 10 and the air-discharge cap 8 are moved up and down by lift mechanisms separate from each other. The air-discharge cap 8 and the projections 8*a* inside the air-discharge cap 8 may be moved up and down by different lift mechanisms, respectively. It is further allowable that the valves 17 in the air-discharge channels 7*a* to 7*d* are opened and closed separately.

The air-discharge cap 8 and the purge cap 10 are connected to a suction pump 12 via a switching device 11, respectively. The switching device 11 performs switching between connection and disconnection between the air-discharge cap 8 and purge cap 10 and the suction pump 12.

In a state that the air-discharge cap 8 is connected to the air-discharge channels 7*a* to 7*d* and the air-discharge cap 8 and the suction pump 12 are connected to each other by the switching device 11, when the suction pump 12 is operated, air in the upper spaces inside the ink tanks 5*a* to 5*d* is discharged from the air-discharge channels 7*a* to 7*d* to outside the ink tanks 5*a* to 5*d*.

In a state that the lower surface of the ink-jet head 4, that is, the nozzles 25 are covered by the purge cap 10, and the purge cap 10 and the suction pump 12 are connected to each other by the switching device 11, when the suction pump 12 is operated, a purge operation for sucking the inks in the ink-jet head 4 from the nozzles 25 is performed (suction purge operation).

As generally known, for recovering the jetting performance of the ink-jet head 4, a flushing operation is performed by jetting inks, from all nozzles 25 toward the purge cap 10 or a generally-known container not shown regardless of image data, by driving the ink-jet head 4 in a state that the carriage 2 has moved to a position aside of the transporting region of the recording paper P.

Figure 2:
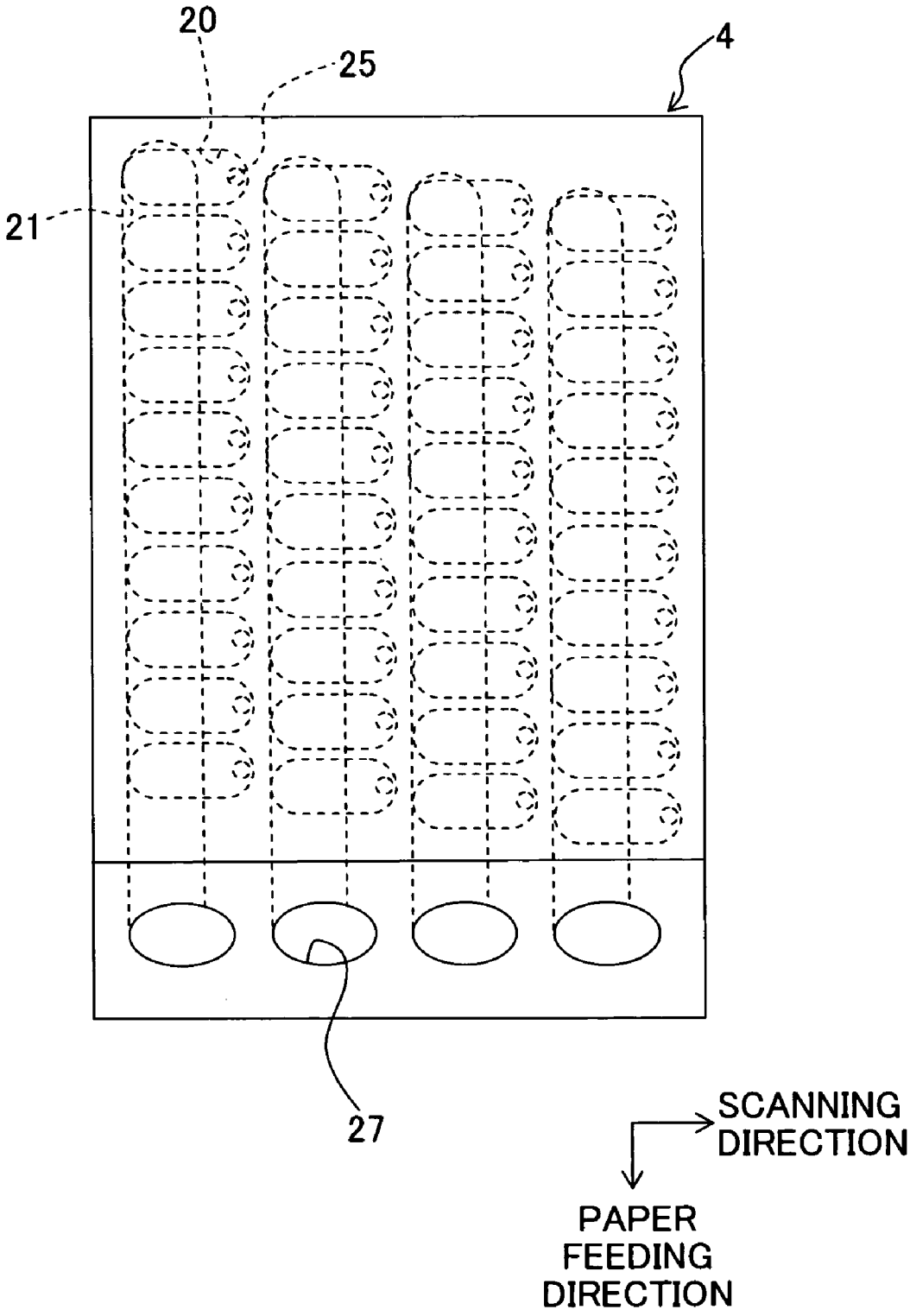
FIG. 2 is a plan view of an ink-jet head.

FIG. 2 is a view showing an example of the ink-jet head 4. The ink-jet head 4 has a number of nozzles 25 arranged in rows for the respective black, yellow, cyan, and magenta inks on the lower surface facing the recording paper, and the nozzles 25 in the rows communicate with manifold channels 21 provided for the respective inks via pressure chambers 20 similar to a generally known ink-jet head. The manifold channel 21 has a supply port 27 at one end communicating with a corresponding sub tank 5, and distributes an ink supplied from the sub tank 5 to the pressure chambers 20. The inks inside the pressure chambers 20 are discharged in the form of liquid droplets from the nozzles 25 to the recording paper by being subjected to discharge energy as generally known. As a discharge energy application mechanism, a mechanism in which a piezoelectric element is deformed, and a mechanism which foams the inks by a heater, etc., are applicable.

Figure 4:
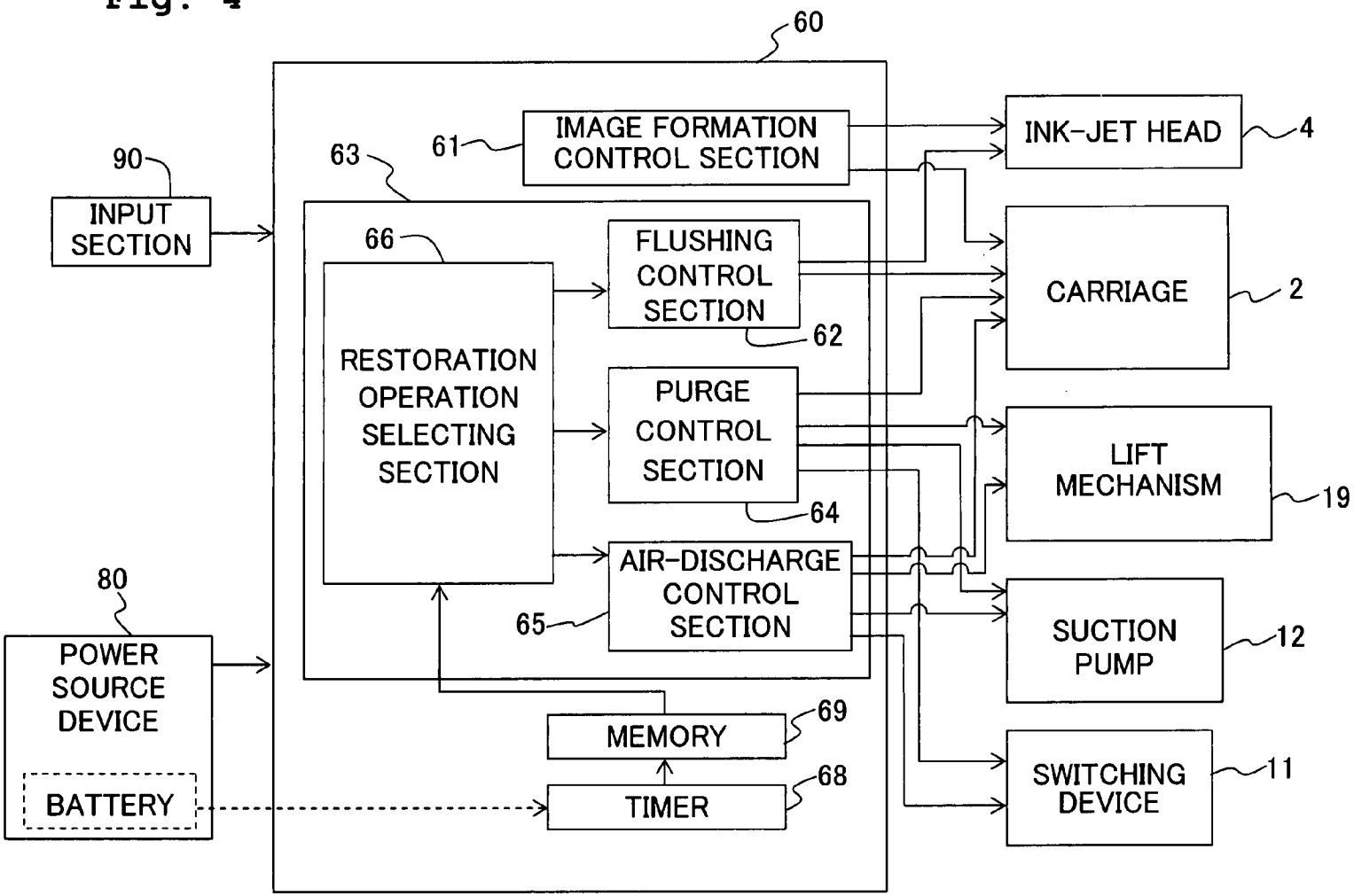
FIG. 4 is a block diagram showing a schematic construction of a controller.

Next, a controller 60 which controls operations of the ink jet printer 1 will be described with reference to FIG. 4. The controller 60 includes a CPU (Central Processing Unit) and memories 69 such as a ROM (Read Only Memory) and a RAM (Random Access Memory), and the like. An image formation control section 61, a jetting function recovery section 63, and a timer 68 are included in the controller 60.

The image formation control section 61 controls the ink-jet head 4, the main scanning device, and the transporting device when forming an image based on image data inputted from a input section 90.

The jetting function recovery section 63 includes a flushing control section 62, a purge control section 64, an air-discharge control section 65, and a recovery operation selecting section 66 which selectively controls these control sections for controlling the recovery devices to operate the purge operation, the air-discharge operation, and the flushing operation. When an image formation command signal based on image data is not inputted into the image formation control section 61, the jetting function recovery section 63 moves the ink-jet head 4 to a position facing the purge cap 10 so that the purge cap 10 covers the nozzles 2. At this time, the switching device 11 does not connect the purge cap 10 and the air-discharge cap 8 to the suction pump 12. In other words, both caps are in close contact with the ink-jet head 4 and the air-discharge channels 7*a* to 7*d*, so that the ink-jet head 4 and the air-discharge channels 7*a* to 7*d* do not communicate with the outside. Instead of the purge cap 10 and the air-discharge cap 8, an exclusive cap may also be used.

The flushing control section 62 performs the flushing operation by controlling the ink-jet head 4 and the carriage 2.

The purge control section 64 performs the suction purge operation by the purge cap 10 by controlling the carriage 2, the lift mechanism 19, the switching device 11, and the suction pump 12.

The air-discharge control section 65 performs the air-discharge operation for discharging air inside the ink tanks 5 by the air-discharge cap 8 by controlling the carriage 2, the lift mechanism 19, the switching device 11, and the suction pump 12.

For discharging air accumulated in the ink tanks 5*a* to 5*d*, the recovery operation selecting section 66 selects a mode for performing only the air-discharge operation (first recovery operation), a mode for performing the suction purge operation (second recovery operation), and a flushing operation based on time data measured by the timer 68 described later and retained in the memory 69, timing of switching ON-OFF of the power supply, timing before image formation, or the like.

The timer 68 measures an elapsed time since a previous recovery operation of the jetting function recovery section 63 until now, and outputs the elapsed time to the memory 69. When the power supply device 80 is provided with a battery, the timer 68 keeps an elapsed time measuring function by the battery for a predetermined period even after the power supply device is disconnected from a commercial power supply, that is, switched OFF, however, thereafter, when the battery runs down, the measured time data is erased and the timer cannot measure the elapsed time. Therefore, in this case, by connecting the power supply device to the commercial power supply again in the predetermined period after disconnection from the commercial power supply, the timer 68 continues the measuring operation. In the case where the power supply device 80 is provided with no battery, when the power supply is switched OFF, the measured time data is immediately erased and the timer cannot measure the elapsed time.

Figure 5A:
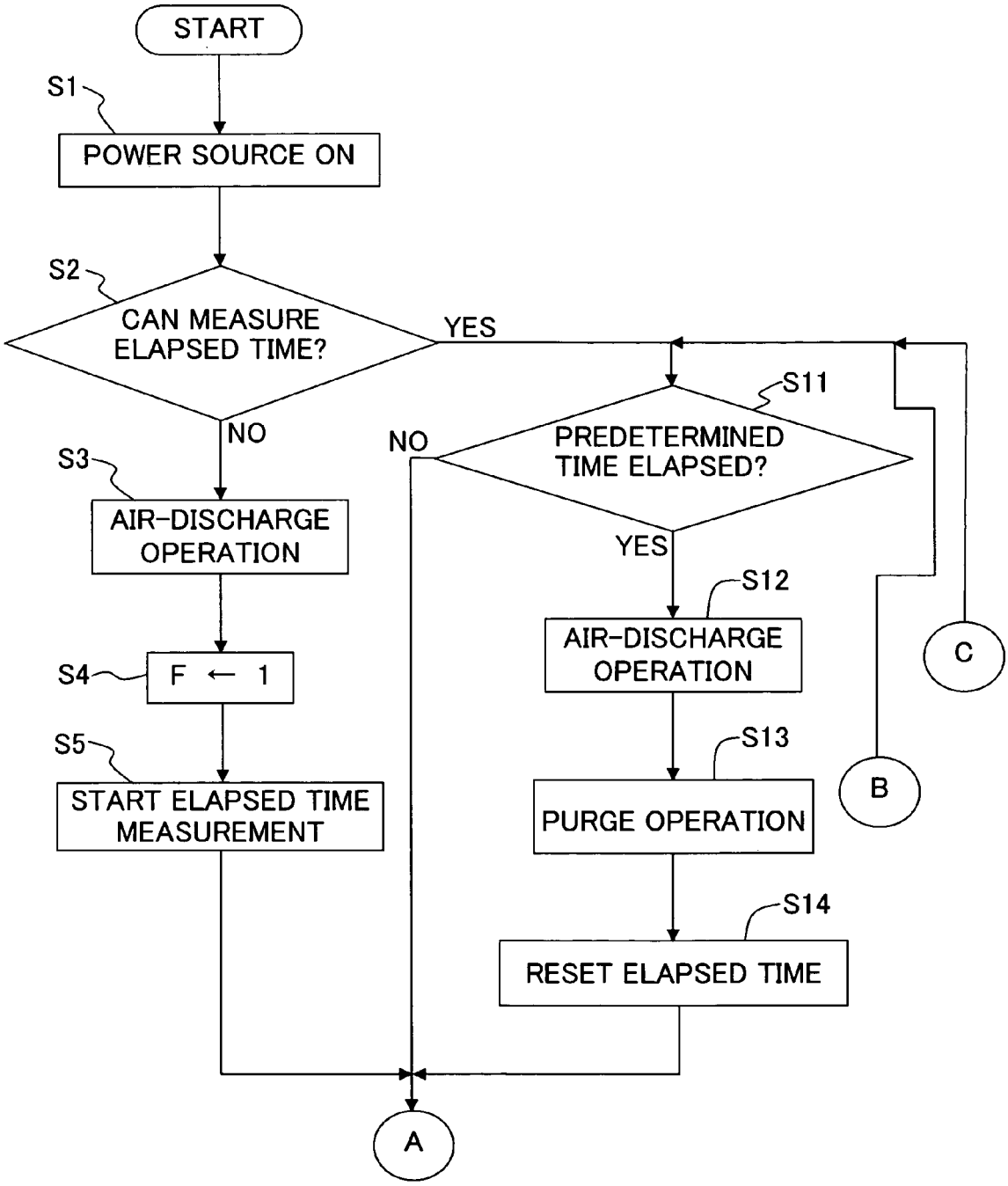
FIG. 5A and FIG. 5B are flowcharts showing a flow until a jetting function recovery operation is performed.
Figure 5B:
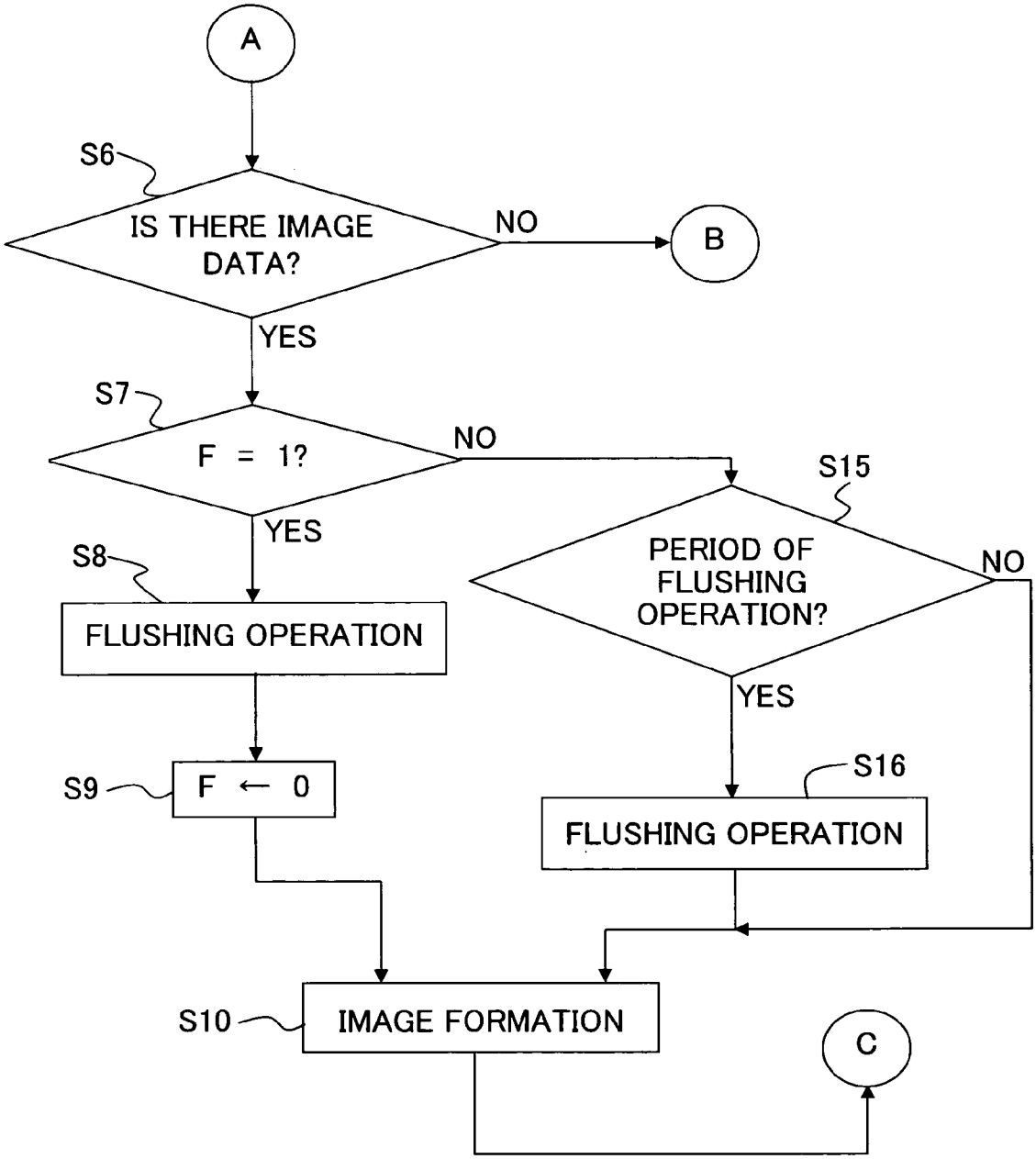

Hereinafter, the flow of jetting function recovery control will be described with reference to FIG. 5A and FIG. 5B. FIG. 5A and FIG. 5B are flowcharts showing the flow of jetting function recovery control. As shown in FIG. 5A, when the power supply of the ink jet printer is switched ON from its OFF state (S1), first, the controller 60 judges the operation state of the timer 68 (S2). Herein, the operation state can be judged by reading the measured elapsed time or depending on whether the battery has run down. When the printer is provided with a battery and the operation of the timer 68 is continued even in the OFF state of the power supply, the elapsed time can be measured by the timer 68 (S2: Yes). However, when the battery runs down or the battery is not provided, the operation of the timer 68 is stopped, so that the elapsed time since the previous recovery operation after the power supply is switched OFF is not retained in the memory 69 (S2: No). In this case, the recovery operation selecting section 66 operates the air-discharge control section 65 to connect the air-discharge cap 8 and the air-discharge channels 7*a* to 7*d*, to connect the air-discharge cap 8 and the suction pump 12 by the switching device 11, and to perform an operation for discharging air accumulated in the upper portions of the ink tanks 5*a* to 5*d* (first recovery operation) (S3), and the controller 60 sets a flag F to 1 (S4) to make the timer 68 start measuring the elapsed time (S5).

While the power source is switched OFF, the ink-jet head 4 is covered by the purge cap 10 or another exclusive cap, so that the inks in the nozzles are hardly dried, so that even when the inks are jetted immediately after the power supply is switched ON, a jetting failure is rarely caused. Therefore, the operations for discharging liquid from the nozzles, that is, the purge operation and the flushing operation are not performed as the jetting function recovery operation.

If air grows in the inks inside the ink tanks 5*a* to 5*b* with the elapse of time and a large amount of air is accumulated in the upper portions of the ink tanks 5*a* to 5*d*, when jetting the inks from the nozzles for forming an image, the period until the air is pulled into the nozzles and causes a jetting failure becomes shorter. Therefore, as the jetting function recovery operation, by discharging the air from the ink tanks as in the case of S3 described above, the inks are introduced into the ink tanks 5*a* to 5*d* from the ink cartridges 14*a* to 14*d* so that the jetting operation can be started without a problem. If the amount of air accumulated in the ink tanks is large, as described later, when performing the second recovery operation for discharging the inks from the nozzles in predetermined periods, etc., the air is suctioned into the nozzles due to a suction operation and then may cause a jetting failure when jetting inks for forming an image. However, as described above, by reducing the amount of air in the ink tanks by the first recovery operation, the above-described problem can be avoided when performing a next purge operation for discharging the inks from the nozzles in the second recovery operation. Therefore, even if the timer 68 cannot measure the time due to being switched OFF of the power supply, after the power supply is switched ON, an image formation operation with less jetting failure can be started with smaller consumption of the inks. The air discharge amount in the first recovery operation may be equal to the air discharge amount in the second recovery operation, however, preferably, the air discharge amount in the first recovery operation is smaller. The air discharge amount can be controlled by the operation time or rotation speed of the suction pump 23 or a combination of these.

It is required that the air amount in the ink tanks 5*a* to 5*d* does not become excessive until the next purge operation of the second recovery operation, so that it is preferable that the air discharge amount in the first recovery operation is not more than the air discharge amount of the second recovery operation. Accordingly, the amount of ink to be discharged together with the air in the first recovery operation can be reduced. It is allowable that the air discharge amounts in both operations are equal to each other.

Then, it is judged whether the image data which was inputted from the input section 90 and to be image-formed is present in a known image memory inside the controller 60

(S6). When the image data is present therein (S6: Yes), and the flag F=1, that is, the elapsed time is unknown due to OFF of the power supply (S7: Yes), at a timing before starting image formation, the recovery operation selecting section 66 operates the flushing control section 62 to perform a flushing operation for jetting inks from the nozzles of the ink-jet head 4 regardless of the image data (S8), and resets the flag F to 0 (S9). At this time, the number of times of jetting the inks from the nozzles by the flushing operation is set to be greater than the number of times of jetting in the flushing operation after the second recovery operation described later. The operation for discharging inks from the nozzles 25 by the suction purge operation is not performed in the first recovery operation, so that the inks inside the nozzles 25 may be dried. Therefore, by increasing the number of times of jetting in the flushing operation, dried inks inside the nozzles 25 are reliably discharged.

Thereafter, the image formation control section 61 moves and scans the carriage 2 to perform image formation on the paper based on the image data by the ink-jet head 4 (S10). This image formation is performed in units of one or a plurality of scanning movements of the carriage 2, that is, in units of one or a plurality of lines on the paper.

On the other hand, when the elapsed time can be measured by the timer 68 at Step S2 (S2: YES), and when the image formation in the units (S10) is finished, the controller 60 judges whether the measured time is over a predetermined time (S11). When the measured time is over the predetermined time, that is, the predetermined time elapsed since the air-discharge operation of the first recovery operation (S3) or the previous recovery operation of the second recovery operation (S11: Yes), the recovery operation selecting section 66 selects the second recovery operation. In the second recovery operation, first, the air-discharge control section 65 is operated, and in the same manner as in the first recovery operation, the air-discharge cap 8 and the air-discharge channels 7*a* to 7*d* are connected, the air-discharge cap 8 and the suction pump 12 are connected by the switching device 11, and an operation for discharging air accumulated in the upper portions of the ink tanks 5*a* to 5*d* is performed (S12). Next, the purge control section 64 is operated to connect the purge cap 10 and the suction pump 12 by the switching device 11 in a state that the nozzles 25 are covered by the purge cap 10, and perform a suction purge operation for sucking and discharging inks from the nozzles 25 (S13). When the second recovery operation is executed, the timer 68 is reset and time measurement for the next second recovery operation is restarted (S14).

The air-discharge operation (S12) before the purge operation (S13) as described above is for preventing air accumulated in the upper portions of the ink tanks 5*a* to 5*d* from being pulled into the nozzles when performing a purge operation from the nozzles, by discharging the air in advance. Therefore, unless the drying of the inks in the nozzles influence the jetting operation or the air accumulated in the ink tanks 5*a* to 5*d* is pulled into the ink-jet head 4 during the jetting operation, the period of the second recovery operation can be made as long as possible. Accordingly, even if a large amount of air is accumulated in the ink tanks 5*a* to 5*d*, by discharging it by the air discharge operation (S12), new inks are introduced into the ink tanks 5*a* to 5*d* from the ink cartridges 14*a* to 14*d*, so that the purge operation (S13) can be performed without pulling air into the nozzles.

Thereafter, when there is image data to be image-formed (S6: Yes), in this case, the flag F=0 (S7: No), so that it is judged at S15 whether the period of the flushing operation has come. The flushing control section 62 is set so as to insert the flushing operation every plurality of image formations before starting the image formations. The periods of the flushing operation may be controlled by time measurement by the timer 68. In this case, the period of the flushing operation and the period of the second recovery operation are set to be different periods.

When the period of the flushing operation has come at S15 (S15: Yes), the flushing operation is performed (S16), and when the period has not come (S15: No), image formation operation is performed (S10). Since the flushing operation (S16) in this case is inserted during image formation, drying of the inks in the nozzles 25 is less, so that it is allowable that the number of times of jetting may be smaller than that of the flushing operation at S8 described above.

When the time measured by the timer 68 has not been over the predetermined time (S11: No) and there is image data to be image-formed (S6: Yes), image formation is performed as described above. When there is no image data (S6: No), every time the predetermined time elapses (S11: Yes), the recovery operation (S12, S13, S14) of the second recovery operation is performed as described above.

According to the ink jet printer 1 described above, when the timer 68 cannot measure the elapsed time due to OFF of the power supply, after the power supply is switched ON, the controller 60 controls the recovery operation selecting section 66 execute the air-discharge operation of the first recovery operation. In other words, only the operation for discharging air from the ink tanks 5*a* to 5*d* is performed as the jetting function recovery operation, and the suction purge operation for sucking inks from the nozzles 25 is not performed. Therefore, in an environment involving frequent repetition of being switched ON and OFF of the power supply, the amount of inks to be consumed by the jetting function recovery operation performed after the power supply is switched ON can be reduced.

It is also allowable that after the recovery operation of the first recovery operation, if a jetting failure occurs, a key for arbitrarily controlling the controller 60 by a user as generally known is provided, and the second recovery operation is executed by a key operation of this key. It is preferable that, even after the user attached the ink cartridges 14*a* to 14*d* to the ink jet printer 1, not the first recovery operation but the second recovery operation is executed regardless of being switched ON of the power supply.

In the state that the timer 68 can measure the elapsed time, when the predetermined time has elapsed since the previous jetting function recovery operation, the air-discharge operation and the suction purge operation of the second recovery operation are executed by the recovery operation selecting section 66. Accordingly, the ink jetting function can be reliably recovered.

A preferred embodiment of the present invention is described above, however, the present invention is not limited to the above-described embodiment, and can be variously changed within the scope of claims. For example, in the above-described embodiment, the air-discharge operation and the purge operation are performed by the suction pump, however, it is also possible that a positive pressure is applied to the inks from the side of the ink cartridges 14*a* to 14*d* and the air-discharge operation for discharging air from the ink tanks 5*a* to 5*d* is performed in the state that the valves 17 are opened, and the purge operation for discharging inks from the nozzles 25 is performed in the state that the valves 17 are closed.

In the present embodiment, a construction in which the carriage 2 performs scanning along the paper is adopted, however, another construction in which the carriage 2 only stands still and supports the ink-jet head 4 at a position facing the paper, and only the paper moves can be adopted.

In the image forming apparatus of this embodiment, a predetermined history information, that is, an elapsed time measured by the timer since the previous recovery operation is retained in the memory. After the power supply of the image forming apparatus is switched OFF, when a time measured by the timer is not retained due to running-out of the battery, the controller controls the recovery mechanism to make it perform the first recovery operation for discharging air from the liquid tank. However, the history information retained in the memory is not necessarily the elapsed time measured by the timer. For example, it is allowable that the memory includes a counter for retaining various history information, and when the power supply of the image forming apparatus is switched ON, if a certain error occurs in the reading of information retained in the counter, the controller controls the recovery mechanism to make it perform the first recovery operation for discharging air from the liquid tank as described above. In detail, history information such as the size of print data; the number of discharges of ink droplets (number of dots), the number of prints; the number of replacements of the ink cartridge, and/or the number of times of paper jamming is retained in the counter. At this time, when the power supply of the image forming apparatus is switched ON, this information retained by the counter cannot be acquired, or when this information has clearly abnormal values, the controller controls the recovery mechanism to execute the first recovery operation for discharging air from the liquid tank as described above.

In the present embodiment, the image forming apparatus includes a controller, and this controller controls the recovery operation for the ink jet head. However, even if the image forming apparatus does not include the controller as described above, by connecting the image forming apparatus to a computer, various controls which the controller performs in the above-described embodiment can be performed by a computer. In this case, a program for executing various controls by the above-described controller is executed by the computer.

Further, in the present embodiment, an example in which an ink jet printer embodies the image forming apparatus is shown, however, the image forming apparatus is also applicable to an apparatus for producing color filters of liquid crystal display devices by applying a liquid except for inks, for example, colorant in a predetermined pattern or an apparatus for forming wiring patterns of electric circuits by applying conductive liquid linearly.

What is claimed is:

1. An image forming apparatus which forms an image on an image forming medium, comprising:

a liquid tank which stores liquid for forming an image;

a liquid jetting head which is connected to the liquid tank and has a nozzle for jetting the liquid supplied from the liquid tank onto the image forming medium;

a carriage on which the liquid tank and the liquid jetting head are provided;

a recovery mechanism which recovers a liquid jetting function, for jetting the liquid, of the liquid jetting head;

a memory which retains predetermined history information; and a controller which controls the recovery mechanism based on the history information retained by the memory, wherein the recovery mechanism selectively executes two recovery operations of a first recovery operation for discharging air from the liquid tank and a second recovery operation for discharging air from the liquid tank and for discharging the liquid from the nozzle, as an operation for recovering the liquid jetting function of the liquid jetting head, and the controller controls the recovery mechanism to perform the first recovery operation in a case that the history information retained in the memory includes an abnormality when a power supply of the image forming apparatus is switched ON.

2. The image forming apparatus according to claim 1, wherein the controller includes a timer which measures time, and the abnormality in the history information is a state that the time measured by the timer is not retained in the memory.

3. The image forming apparatus according to claim 2, wherein the controller judges whether a predetermined time has elapsed since a latest jetting function recovery operation, based on the time measured by the timer, and when the controller judges that the predetermined time has elapsed, the controller controls the recovery mechanism to execute the second recovery operation.

4. The image forming apparatus according to claim 3, wherein when the power supply of the image forming apparatus is switched ON after the timer becomes unable to measure the time, the controller sets an air discharge amount, from the liquid tank, in the first recovery operation by the recovery mechanism to be not more than an air discharge amount, from the liquid tank, in the second recovery operation by the recovery mechanism in a state that the timer can measure the time.

5. The image forming apparatus according to claim 3, wherein the controller controls the liquid jetting head to execute a flushing operation for jetting the liquid from the nozzle in a region on the outside of a region facing the image forming medium before starting image formation on the image forming medium, and further, in a case that the power supply of the image forming apparatus is switched ON after the timer becomes unable to measure the time, and the controller has controlled the recovery mechanism to execute the first recovery operation, the controller increases the number of times of jetting in the flushing operation, which is to be executed by the liquid jetting head before starting image formation, to be greater than in other cases.

6. The image forming apparatus according to claim 1, wherein the memory includes a counter which retains information about the number of droplets of the liquid jetted from the liquid jetting head, and the abnormality in the history information is a state that the information about the number of droplets is not retained in the counter.

7. The image forming apparatus according to claim 1, wherein the memory includes a counter which retains information about the number of image forming media on which images were formed by the liquid jetting head, and the abnormality in the history information is a state that the information about the number of image forming media on which images were formed is not retained in the counter.

8. A non-transitory information recording medium which is readable by a computer and which includes a computer program recorded on the information recording medium, the computer program causes the computer to:

make a judgment with respect to an image forming apparatus, the image forming apparatus including: a liquid tank which retains an image forming liquid; a liquid jetting head which is connected to the liquid tank and has a nozzle for jetting the liquid supplied from the liquid tank onto an image forming medium; a carriage on which the liquid tank and the liquid jetting head are provided; a recovery mechanism which recovers a liquid jetting function for jetting the liquid of the liquid jetting head; and a memory which retains predetermined history information, the judgment being about whether the history information retained in the memory includes an abnormality when a power supply of the image forming apparatus is switched ON; and control the recovery mechanism to discharge air from the liquid tank when the image forming apparatus judges that the history information includes an abnormality.

9. The non-transitory information recording medium according to claim 8, wherein the controller includes a timer which measures time, and the abnormality in the history information is a state that the time measured by the timer is not retained in the memory.

10. The non-transitory information recording medium according to claim 9, wherein the computer program further causes the computer to judge whether a predetermined time has elapsed since a latest jetting function recovery operation based on the time measured by the timer, and causes the recovery mechanism to discharge air from the liquid tank and to discharge the liquid from the nozzle when the computer judges that the predetermined time has elapsed.

11. The non-transitory information recording medium according to claim 8, wherein the memory includes a counter which retains information about the number of liquid droplets jetted from the liquid jetting head, and the abnormality in the history information is a state that the information about the number of liquid droplets is not retained in the counter.

12. The non-transitory information recording medium according to claim 8, wherein the memory includes a counter which retains information about the number of image forming media on which images were formed by the liquid jetting head, and the abnormality in the history information is a state that the information about the number of image forming media on which images were formed are not retained in the counter.

* * * * *